US011179932B2

(12) United States Patent
Saito et al.

(10) Patent No.: US 11,179,932 B2
(45) Date of Patent: Nov. 23, 2021

(54) LIQUID EJECTION HEAD

(71) Applicant: CANON KABUSHIKI KAISHA, Tokyo (JP)

(72) Inventors: Akio Saito, Machida (JP); Toru Nakakubo, Kawasaki (JP); Yohei Nakamura, Yokohama (JP); Zentaro Tamenaga, Sagamihara (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/673,286

(22) Filed: Nov. 4, 2019

(65) Prior Publication Data

US 2020/0147957 A1 May 14, 2020

(30) Foreign Application Priority Data

Nov. 9, 2018 (JP) ..... JP2018-211665

(51) Int. Cl.
*B41J 2/045* (2006.01)
*B41J 2/14* (2006.01)

(52) U.S. Cl.
CPC ..... *B41J 2/04586* (2013.01); *B41J 2/14* (2013.01)

(58) Field of Classification Search
CPC ... B41J 2/04586; B41J 2/14024; B41J 2/1753
See application file for complete search history.

(56) References Cited

U.S. PATENT DOCUMENTS 9,475,288 B2 * 10/2016 Kudo ..... B41J 2/14
2010/0073424 A1 * 3/2010 Mills ..... B41J 2/155 347/37
2016/0016422 A1 * 1/2016 Kobayashi ..... B41J 2/1753 347/37

FOREIGN PATENT DOCUMENTS

JP 2014-54743 A 3/2014

* cited by examiner

*Primary Examiner* — Lam S Nguyen
(74) *Attorney, Agent, or Firm* — Canon U.S.A., Inc. IP Division

(57) ABSTRACT

A liquid ejection head including a recording element substrate that ejects a liquid, a flow passage member provided with a flow passage that supplies the liquid to the recording element substrate, an elastic member having elasticity disposed between the recording element substrate and the flow passage member, and a fixing member that fixes the recording element substrate and the flow passage member. In the liquid ejection head, an area between the recording element substrate and the flow passage member through which the liquid flows is sealed by having the elastic member be deformed with the fixing member.

15 Claims, 8 Drawing Sheets

FIG. 5A1
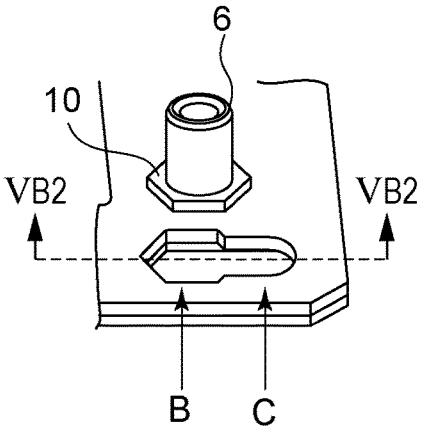
FIG. 5A2
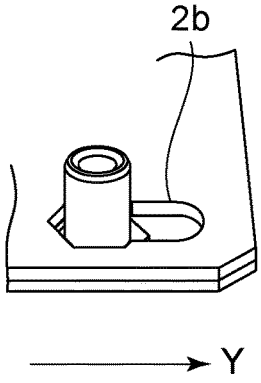
FIG. 5A3
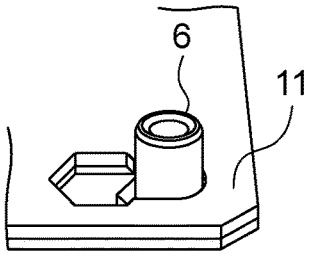
FIG. 5B1
FIG. 5B2
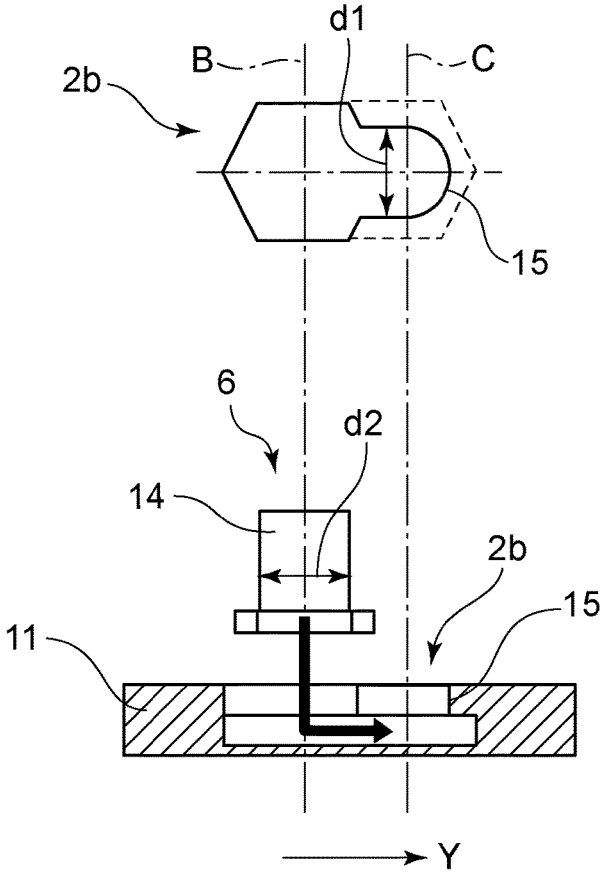

FIG. 8A
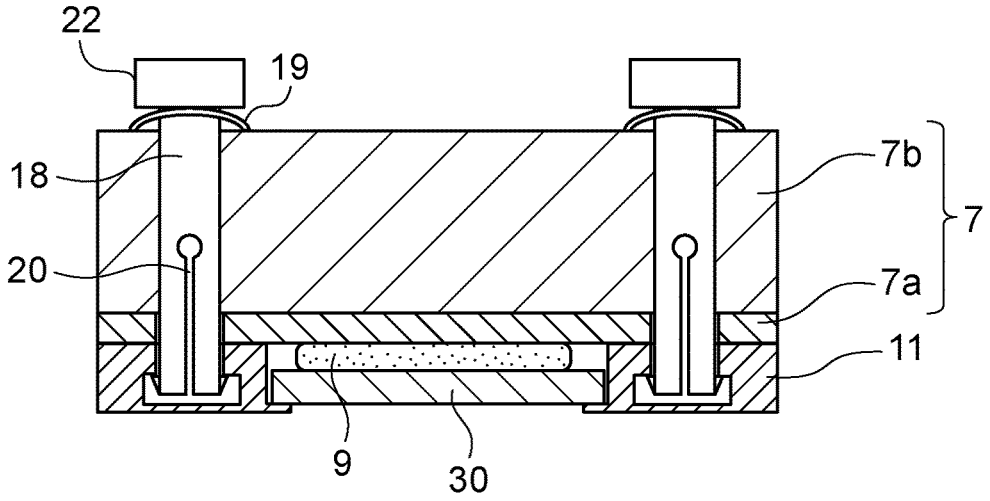
FIG. 8B1
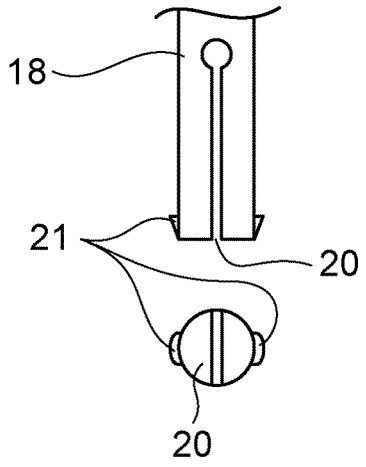
FIG. 8C1
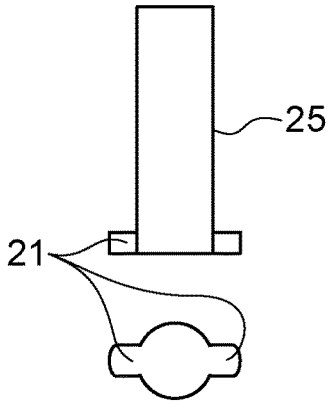
FIG. 8B2
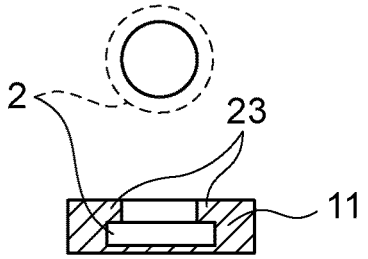
FIG. 8C2
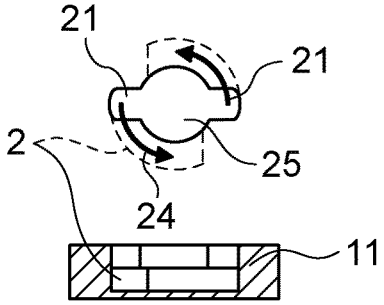

LIQUID EJECTION HEAD

BACKGROUND OF THE INVENTION

Field of the Invention

The present disclosure relates to a liquid ejection head that ejects a liquid.

Description of the Related Art

Typically, a liquid ejection head that ejects a liquid includes a recording element substrate that includes ejection ports that eject the liquid and a pressure generating element that applies pressure to the liquid, and a flow passage member that includes a flow passage through which the liquid that is to be ejected is supplied to the recording element substrate. As illustrated in Japanese Patent Laid-Open No. 2014-54743, the recording element substrate and the flow passage member are joined with an adhesive agent and a portion around a connection portion of the flow passage is sealed so that the liquid does not leak to a portion external to the flow passage.

An adhesive agent is generally known to, when exposed to a liquid for a long period of time, gradually loose its adhesiveness due to a component included in the liquid. Among the adhesive agents used in the liquid ejection head, the adhesive agent used to seal between the flow passage member and the recording element substrate is also exposed to a liquid (ink) for a long period of time; accordingly, there are cases in which the adhesion of the adhesive agent decreases. Furthermore, due to the decrease in the adhesion, the adhesive agent may peel off and the liquid may leak to a portion external to the flow passage from the flow passage member to the recording element substrate.

SUMMARY OF THE INVENTION

In view of the above, the present disclosure provides a liquid ejection head that can suppress leakage of a liquid to a portion external to a flow passage from a flow passage member to a recording element substrate.

The present disclosure provides a liquid ejection head including a recording element substrate including an ejection port that ejects a liquid, a flow passage member provided with a flow passage that supplies the liquid to the recording element substrate, a cover member provided with an opening that exposes the ejection port, the cover member being disposed on a surface on a side on which the ejection port of the recording element substrate is formed, an elastic member having elasticity disposed between the recording element substrate and the flow passage member, and a fixing member that fixes the recording element substrate and the flow passage member. In the liquid ejection head, an area between the recording element substrate and the flow passage member through which the liquid flows is sealed by having the elastic member be deformed with the fixing member, and the fixing member performs pressing on the recording element substrate by pressing the cover member.

Further features of the present disclosure will become apparent from the following description of exemplary embodiments with reference to the attached drawings.

BRIEF DESCRIPTION OF THE DRAWINGS

FIGS. 5A1 to 5A3 are enlarged views of a portion of a cover member of a second embodiment. FIG. 5B2 is a schematic view taken along line VB2-VB2 in FIG. 5A1, and FIG. 5B1 is a top view of the schematic view.

FIGS. 8A, 8B1, 8B2, 8C1, and 8C2 are schematic views illustrating modifications of a third embodiment.

DESCRIPTION OF THE EMBODIMENTS

Hereinafter, embodiments of a liquid ejection head according to the present disclosure will be described with reference to the drawings. Note that the following description does not limit the scope of the present disclosure. In the embodiments, an ink jet head that ejects a liquid, such as ink, is described as an example of the liquid ejection head; however, not limited to the above, the present disclosure can be applied to liquid ejection heads that eject various droplets. While a thermal method, in which ink is ejected by creating a bubble with a heating element that heats the liquid, is adopted in the liquid ejection head, the present disclosure can be used in liquid ejection heads adopting a piezoelectric method and other various liquid ejection methods. Furthermore, while the liquid ejection heads of the embodiments are described as a so-called page-wide head that has a length corresponding to the width of the printed medium, the present disclosure can be applied to a so-called serial liquid ejection head that performs recording while scanning the printed medium. The serial liquid ejection head includes, for example, a configuration in which a single recording element substrate for black ink and a single recording element substrate for chromatic color ink are mounted, or a configuration in which a few recording element substrates are disposed in an ejection port array direction so as to overlap the ejection ports.

First Embodiment

Liquid Ejection Head

Figure 1:
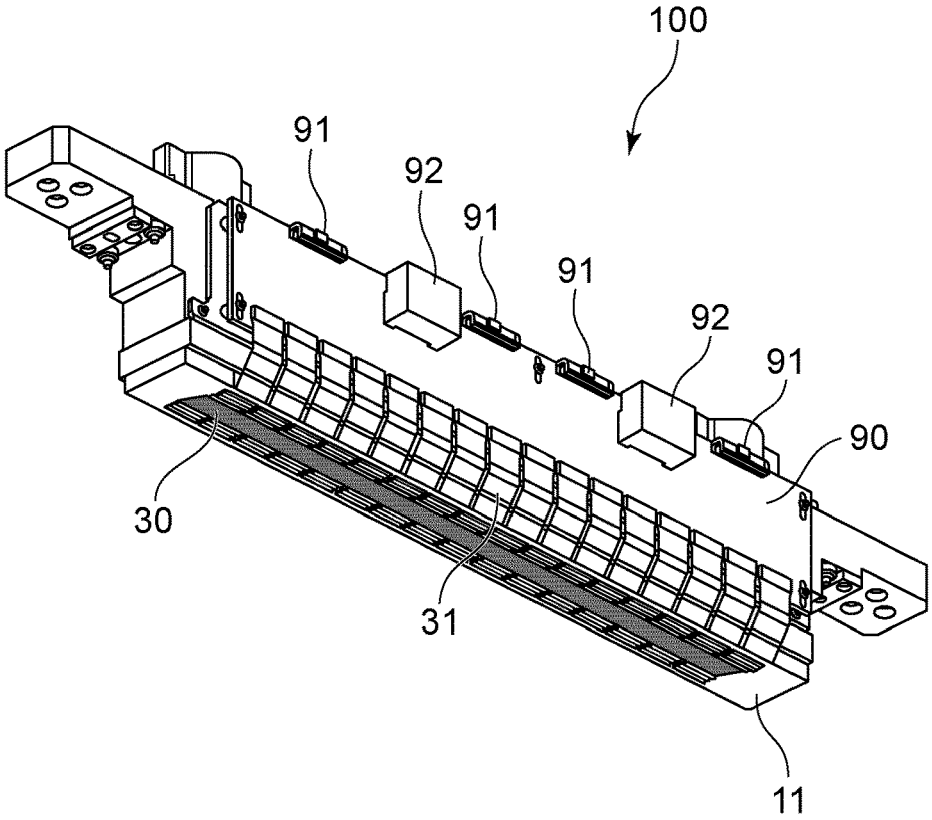
FIG. 1 is a perspective view illustrating a liquid ejection head.

A liquid ejection head according to the present embodiment will be described with reference to FIGS. 1 and 2. FIG. 1 is a perspective view illustrating a liquid ejection head 100 according to the present embodiment. The liquid ejection head 100 of the present embodiment is a page wide liquid ejection head in which 16 recording element substrates 30 that are capable of ejecting inks of four colors C, M, Y, and K on a printed medium such as paper are arranged in a straight line (disposed inline). The liquid ejection head 100 includes the recording element substrates 30, flexible electric wiring members 31, plate-shaped electric wiring substrates 90, signal input terminals 91, and power supply terminals 92. The signal input terminals 91 and the power supply terminals 92 are electrically coupled to a control unit of a printing apparatus body (not shown) including a conveying unit (not shown) that conveys a printed medium (not shown), and the liquid ejection head 100. Furthermore, an ejection drive signal and electric power needed for the ejection are supplied to each recording element substrate 30 through the corresponding electric wiring member 31. The electric wiring member 31 is a flexible printed circuit (FPC), for example.

Note that while a page wide liquid ejection head in which the recording element substrates 30 are disposed in a straight line in a longitudinal direction of the liquid ejection head is illustrated in FIG. 1, the present disclosure is not limited to such a page wide liquid ejection head and may be a page wide liquid ejection head in which the recording element substrates 30 are disposed in a staggered manner in the longitudinal direction.

Figure 2:
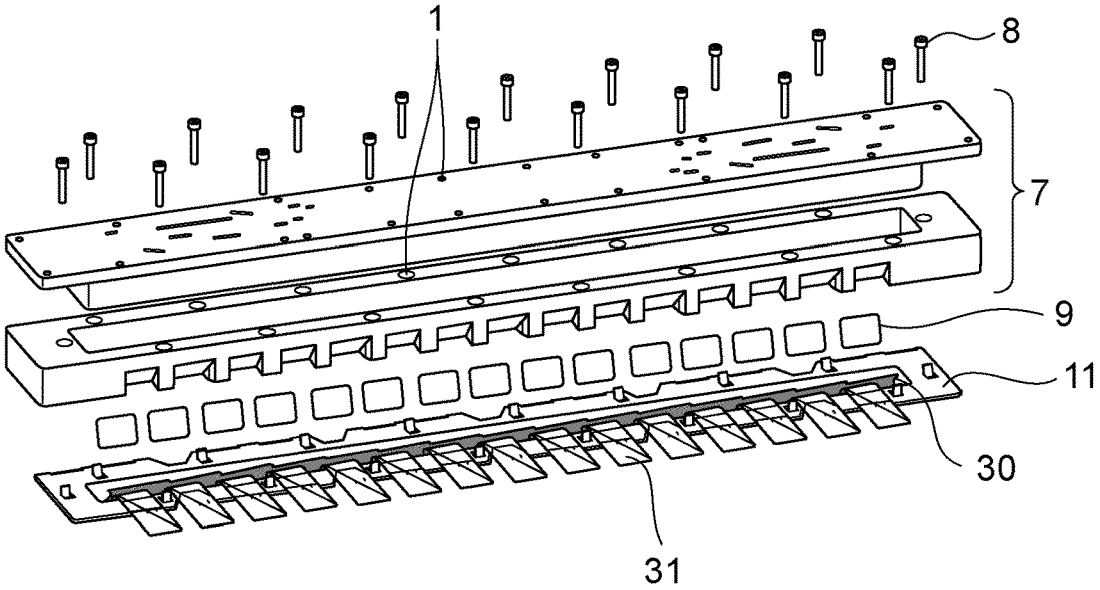
FIG. 2 is an exploded perspective view of a portion of the liquid ejection head.

FIG. 2 is an exploded perspective view of the liquid ejection head 100 illustrated in FIG. 1 and is a drawing selectively illustrating the plurality of recording element substrates 30 and a flow passage member 7 that supplies a liquid to the recording element substrates 30. Note that while the liquid ejection head 100 having 16 recording element substrates 30 arranged in a straight line is illustrated in FIG. 1, an example in which 15 recording element substrates 30 are disposed is illustrated in FIG. 2. The flow passage member 7 distributes the liquid supplied from the printing apparatus body to the recording element substrates 30. Elastic members 9 provided between the recording element substrates 30 and the flow passage member 7 seal the flow passage so that the liquid does not leak to a portion external to the flow passage, A material of the elastic member 9 may be any material that is deformed by a fixing member described later in detail and includes ethylene propylene rubber, for example.

The electric wiring member 31 that supplies electric power that drives the recording element substrate 30 is attached to the recording element substrate 30. A plurality of integral pieces formed by coupling the recording element substrate 30 and the electric wiring member 31 to each other are provided in a cover member 11. While the details will be described later, nuts 6 (FIGS. 3A and 3B) are provided in the cover member 11. The nuts 6 are fastened to bolts 8 inserted through through holes 1 formed in the flow passage member 7. With the above, the elastic members 9 are crushed a predetermined amount so that the recording €lenient substrates 30 and the elastic members 9, and the elastic members 9 and the flow passage member 7 are adhered to each other to form a flow passage connecting each other.

Coupling Recording Element Substrates and Flow Passage Member to Each Other

Figure 3A:
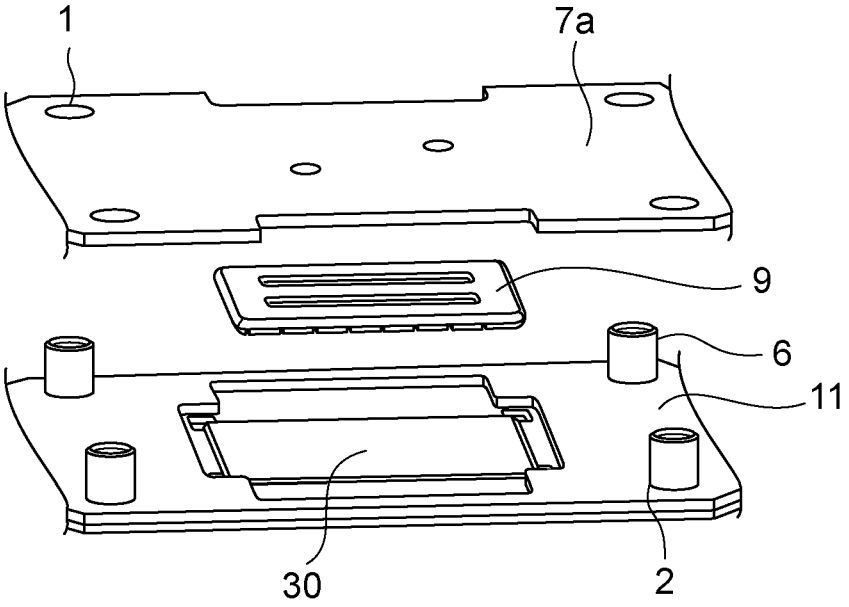
FIG. 3A is a schematic view illustrating the cover member, the recording element substrate, and a first flow passage member, which is a portion of the flow passage member, in an enlarged manner.
Figure 3B:
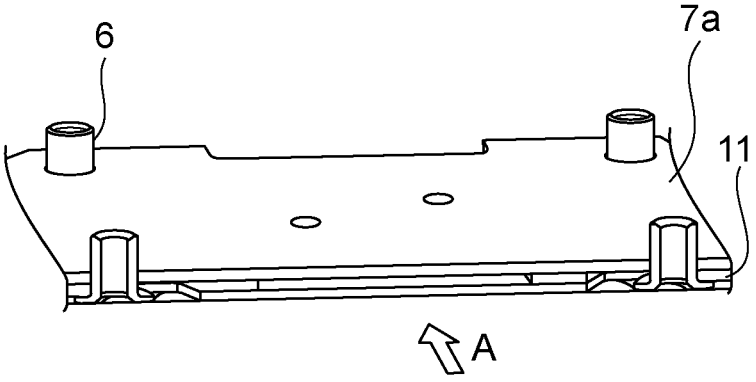
FIG. 3B is a schematic view illustrating a state in which the above members have been fastened.

Coupling between the recording element substrate 30 and the flow passage member 7, which is a feature portion of the present disclosure, will be described with reference to FIGS. 3A, 3B, 4A, and 4B. FIG. 3A is a schematic view illustrating the cover member 11, the recording element substrate 30, and a first flow passage member 7*a*, which is a portion of the flow passage member 7, in an enlarged manner, and FIG. 3B is a schematic view illustrating a state in which the above members have been fastened. Note that in FIG. 2, an example in which a plurality of recording element substrates 30 are fixed to a single cover member 11, and an example in which a liquid is supplied to a plurality of recording element substrates 30 from a single flow passage member 7 have been given. However, in FIGS. 3A and 3B, in order to facilitate the description, an example in which a single recording element substrate 30 is fixed to the cover member 11, and an example in which a liquid is supplied to the single recording element substrate 30 from a single flow passage member 7 (the first flow passage member 7*a*) are illustrated. As illustrated in FIGS. 3A and 3B, the present disclosure can also be applied to a case in which a single recording element substrate is fixed to the cover member 11. Similarly, for the sake of description, only the first flow passage member 7*a*, which is a simplified version of the flow passage member 7 illustrated in FIG. 2, will be illustrated in FIGS. 3A and 3B. Similarly, in FIGS. 4A and 4B as well, an example in which a single recording element substrate 30 is fixed to the cover member 11 and in which the first flow passage member 7*a* is used is illustrated.

As illustrated in FIG. 3A, four holes 2 are formed in the cover member 11 and around the recording element substrates 30. The nut 6, which is one of the members that fasten the recording element substrate 30 and the first flow passage member 7*a*, is inserted in each hole 2. The recording element substrate 30 is fixed to the cover member 11 so that a surface of the recording element substrate 30, which is a surface opposite a surface in which the ejection ports (not shown) that eject the liquid are formed, is in contact with the elastic member 9. Binding between the first flow passage member 7*a*, which is a portion of the flow passage member, and the recording element substrate 30 is, as illustrated in FIG. 3B, performed by fastening the bolts 8 (FIGS. 4A and 4B) and the nuts 6 while the through holes 1, which are formed in the first flow passage member 7*a* and are in communication with the holes 2, and the nuts 6 are engaged with each other.

Figure 4A:
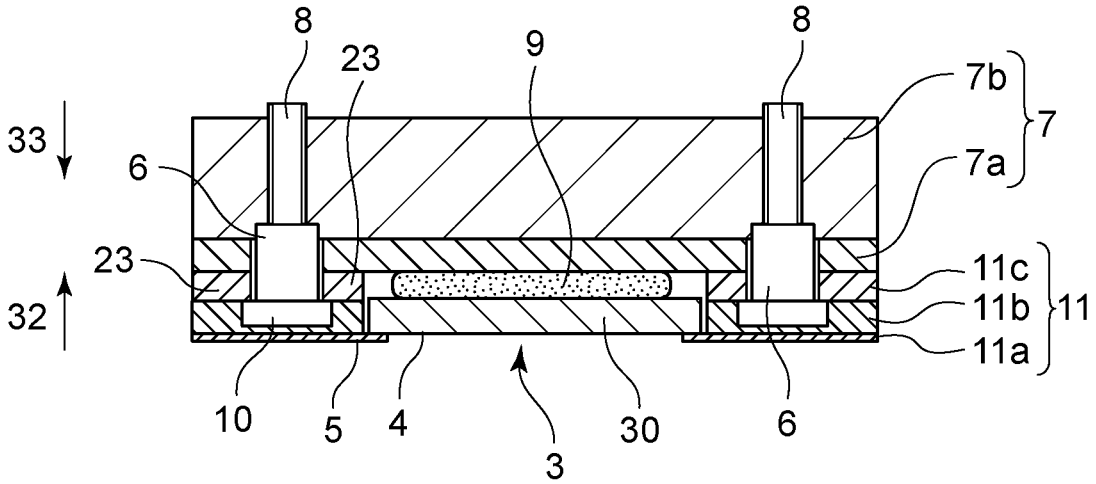
FIG. 4A is a schematic view illustrating a state of the recording element substrate, the flow passage member, and the cover member viewed in a direction IVA illustrated in FIG. 3B.
Figure 4B:
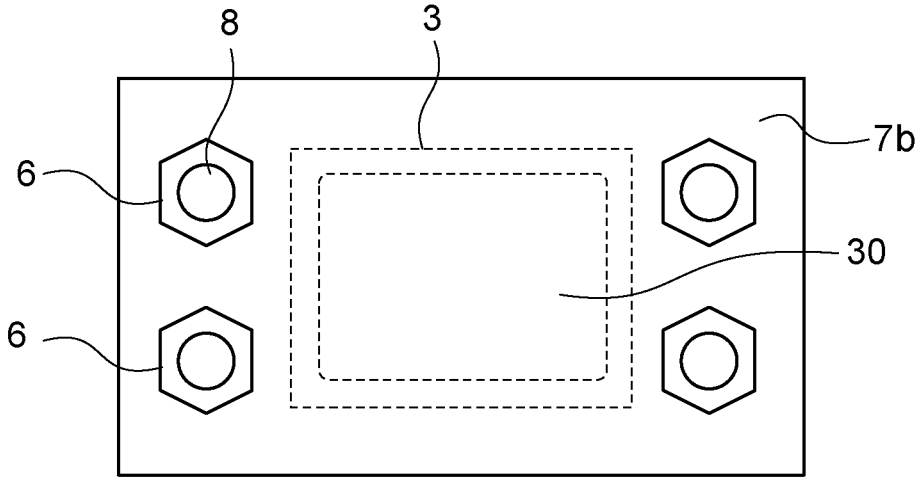
FIG. 4B illustrates a top view of FIG. 4A.

FIG. 4A is a schematic view illustrating a state of the recording element substrate 30, the flow passage member 7, and the cover member 11 viewed in a direction IVA illustrated in FIG. 3B. Note that for the sake of description, the nuts 6, the corresponding bolts 8, and a second flow passage member 7*b*, which constitutes the flow passage member 7 together with the first flow passage member 7*a*, are added in the drawing. FIG. 4B illustrates a top view of FIG. 4A. In the present embodiment, the nuts 6 and the bolts 8 are used as the fixing members that couple the recording element substrate 30 and the flow passage member 7 to each other.

As illustrated in FIG. 4A, the cover member 11 is formed by layering a first plate 11*a*, a second plate 11*b*, and a third plate 11*c*, which are each a thin sheet-shaped member, on each other Furthermore, the members are integrally formed by adhering the members with an adhesive agent or by directly joining the members by welding. In the present embodiment, SUS 430 is used for the plates 11*a* to 11*c*, and the plates are joined by high-temperature and high-pressure thermocompression bonding. Note that other metal materials can be used. However, in such a case, it is desirable that a material with excellent corrosion resistivity and a low linear expansion coefficient is used.

The recording element substrate 30 is in contact with an inner surface of the first plate 11*a*. An opening 3 that exposes a surface (an ejection port surface 4) of the recording element substrate 30, which is on the side in which the ejection ports (not shown) are formed, is provided in the cover member 11. While holes through which the nuts 6 are inserted are provided in the second plate 11*b* and the third plate 11*c* of the cover member 11, no holes are provided in the first plate 11*a*. Accordingly, the nuts 6 that are fixing members are not exposed in a face surface 5 of the cover member 11. Furthermore, since the thickness of the first plate 11*a* is thin and is 80 μm or less in the present embodiment, the difference in level between the face surface 5 of the cover member 11 and the ejection port surface 4 of the recording element substrate 30 is equivalent to the slight thickness of the first plate 11*a*; accordingly, the surface of the liquid ejection head 100 (FIG. 1) on the side that faces the printed medium is substantially flat. Accordingly, the distance between the ejection port and the printed medium can be reduced, which contributes to an improvement in the printing quality. Furthermore, wiping that cleans the side on which the recording element substrate 30 of the liquid ejection head 100 is disposed is facilitated as well.

The coupling between the recording element substrate 30 and the flow passage member 7 is performed by disposing the elastic member 9 between the above two members and by fastening the nuts 6 inserted through the cover member 11 and the bolts 8 inserted through the flow passage member 7. In so doing, flanges 10 of the nuts 6 and areas 23 (hereinafter, referred to as engagement areas 23) of the third plate 11*c* are engaged with each other. By so doing, the recording element substrate 30 is, through the cover member 11, pushed in a direction (an arrow 32) extending towards where the flow passage member 7 is disposed, and the flow passage member 7 is pressed in a direction (an arrow 33) extending towards where the recording element substrate 30 is disposed; accordingly, the elastic member 9 becomes deformed. Accordingly, the area between the recording element substrate 30 and the flow passage member 7 in which the liquid flows can be sealed with the elasticity deformed elastic member 9, and the recording element substrate 30 and the flow passage member 7 can be coupled to each other without any liquid (ink) leakage between the recording element substrate 30 and the flow passage member 7.

An opening (not shown) that supplies the liquid to the recording element substrate 30 is formed in a surface of the flow passage member 7 joined to the recording element substrate 30, and an opening (not shown) to which the liquid from the opening of the flow passage member 7 is supplied is formed in the recording element substrate 30. Furthermore, a flow passage (an opening portion, not shown) that connects the openings of the flow passage member 7 and the recording element substrate 30 is formed in the elastic member 9. The opening portion of the elastic member 9 seals the flow passage of the liquid between the flow passage member 7 and the Mastic member 9, and that between the elastic member 9 and the recording element substrate 30. Furthermore, as illustrated in FIG. 2, a single elastic member 9 may be provided in each of the plurality of recording element substrates 30, or a single long elastic member 9 common to the plurality of recording element substrates 30 may be provided.

Note that in the present embodiment, the nuts 6 are inserted in the cover member 11 and are fastened to the bolts 8; however, the bolts 8 may be inserted in the cover member 11 and be fastened with the nuts 6. Furthermore, in the present embodiment, the elastic member is crushed with the nuts 6 and the screws; however, if the elastic member 9 can be sufficiently crushed to a degree compensating the component tolerance and the installation tolerance and the crushed state can be maintained, another mechanical fastening method can be selected according to the intended use. Alternatively, without having the cover member 11 interposed in between, the nuts 6 or the bolts 8 may be in contact directly with and may directly press the recording element substrate 30 to deform the elastic member 9 and couple the recording element substrate 30 and the flow passage member 7 to each other.

As described above, by providing the elastic member between the recording element substrate 30 and the flow passage member 7, the liquid can be made to flow between the recording element substrate 30 and the flow passage member 7 through the flow passage (the opening portion) formed in the elastic member while preventing the liquid from leaking to an external portion. Furthermore, as a configuration of the recording element substrate 30, when a plurality of types of ink are ejected with a single recording element substrate 30, the number of flow passages increases according to the number of the types of ink; accordingly, the intervals between the flow passages become small. The present disclosure can be applied in a further effective manner in a configuration such as the above in which the flow passages are provided in a highly dense manner.

Second Embodiment

Figure 6A:
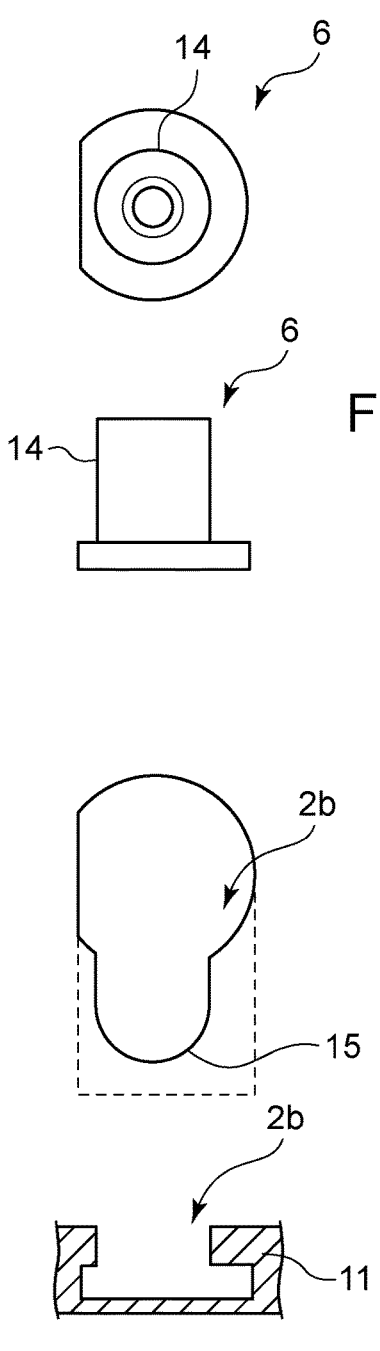
FIGS. 6A and 6B are schematic views illustrating modifications of the second embodiment.
Figure 6B:
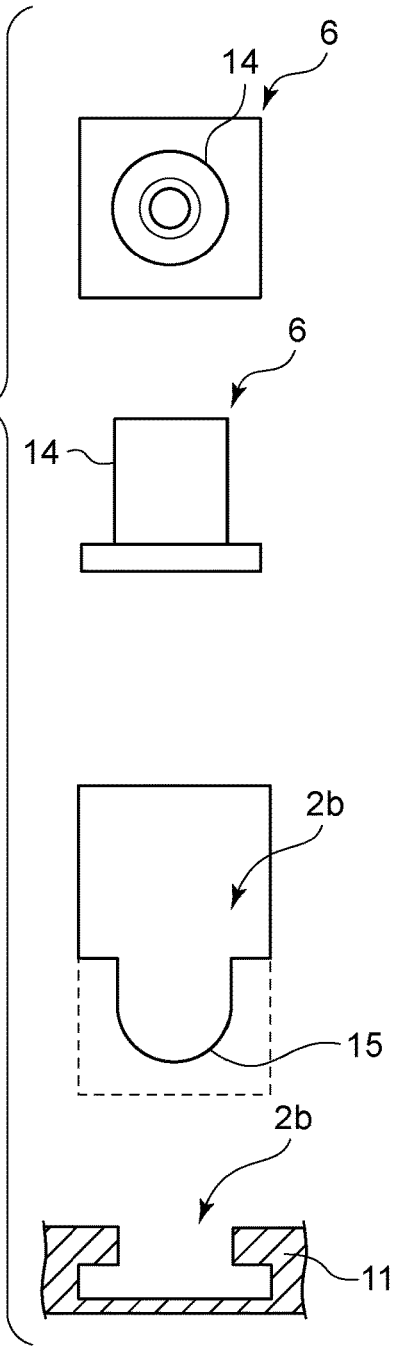

A second embodiment of the present disclosure will be described with reference to FIGS. 5A1 to 7. Note that components similar to those of the first embodiment will be attached with the same reference numerals and description thereof will be omitted. A feature portion of the present embodiment is that holes 2*b* of the cover member 11 are provided with a shape allowing the nuts inserted in the holes to slide inside the holes. FIG. 5A1 to 5A3 are enlarged views of a portion of the cover member 11 according to the present embodiment. FIG. 5B2 is a schematic view taken along line VB2-VB2 in FIG. 5A1, and FIG. 5B1 is a top view of the schematic view. FIGS. 6A and 6B are schematic views illustrating modifications of the nut 6 and the hole 2*b*. Note that in FIGS. 5A1 to 5B2, for the sake of description, only the cover member 11 and the nut 6 are illustrated.

In the present embodiment, first, the nut 6 is inserted into the cover member 11 at an insertion position B (a first area) where there is an opening that is larger than the size (a flange diameter) of the flange 10 (FIG. 5A2). Subsequently, the nut 6 is slid in a Y direction and the nut is disposed at a fastening position C (a second area) that is a position where a cylindrical portion 14 of the nut 6 comes in contact with a circular edge portion 15 of the hole 2*b* (FIG. 5A3). Subsequently, the nut 6 and the bolt are fastened at the fastening position C (the second area). In the above, a width d1 of the hole 2*b* in the fastening position C is smaller than the flange diameter and is slightly larger than a diameter (a flat diameter d2) of the cylindrical portion 14 of the nut. With such a configuration, the nut 6 can be moved to a position where the nut 6 is positionally stable and can be fastened to the bolt. In other words, the nut 6 is fixed at the fastening position C in a stable manner, and when the nut 6 and the bolt are fastened, the nut 6 can be prevented from shifting from the fastening position; accordingly, a positional accuracy between the flow passage member 7 and the recording element substrate 30 can be improved.

Figure 7:
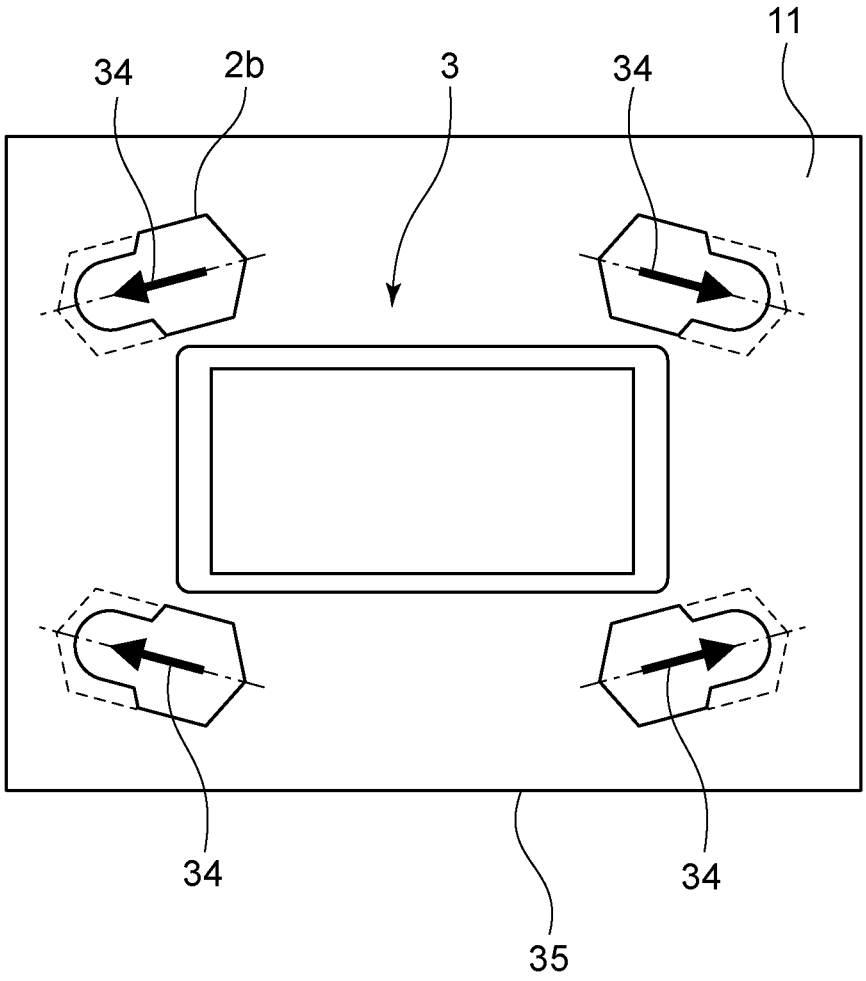
FIG. 7 is a schematic view illustrating a modification of the second embodiment.

FIGS. 6A and 6B are modifications of the nut 6 and the hole 2*b* according to the present embodiment, and illustrate a side view and a top view of the nut 6, and a cross-sectional view and a top view of the hole 2*b*. In FIGS. 5A1 to 5B2, while a hexagonal nut is illustrated as the nut 6, the present embodiment is not limited to a hexagonal nut and nuts having various shapes such as those illustrated in FIGS. 6A and 6B may be used. Furthermore, FIG. 7 is a schematic view of the cover member 11 illustrating a modification of the holes 2*b* according to the present embodiment. As illustrated in the drawing, the sliding directions (arrows 34) of the nuts are inclined with respect to the direction in which the long sides 35 of the cover member 11 extend. The inclination in the sliding direction may be determined as appropriate considering the positional relationship with other structures and the ease of assembling the liquid ejection head.

Third Embodiment

A third embodiment of the present disclosure will be described with reference to FIGS. 8A to 8C2. Note that components similar to those of the first embodiment will be attached with the same reference numerals and description thereof will be omitted. A feature portion of the present embodiment is that, rather than the nuts and the bolts, snaps and washers are used as the members fixing the recording element substrate 30 and the flow passage member 7 to each other. Note that FIGS. 8A to 8C2 illustrates, as an example, a case in which wave washers are used as the washers. FIG. 8A is a schematic view of a state in which the recording element substrate 30 and the flow passage member 7 are fastened with snaps 18 and wave washers 19 viewed from the direction VIIIA in FIG. 3B. FIGS. 8B1 and 8B2 are schematic views illustrating shapes of the snap 18 illustrated in FIG. 8A and the hole 2 corresponding to the snap 18, and FIGS. 8C1 and 8C2 are schematic views illustrating shapes of the snap 18, the snap 18 being a type in which claws of the snap are hooked by rotation, and the hole 2 corresponding to the snap 18.

In the present embodiment, fastening of the recording element substrate 30 and the flow passage member 7 is performed by the snaps 18 and the wave washers 19 disposed below heads 22 of the snaps 18. The recording element substrate 30 and the flow passage member 7 are pressed by crushing the wave washers 19 a predetermined amount with the snaps 18 and the head 22. As illustrated in FIG. 8B1, in each snap 18 illustrated in FIG. 8A, a slit 20 is formed at an leading end portion of the snap 18 and, further, two claws 21 are provided in a direction orthogonal to the slit 20. Furthermore, engagement areas 23 are formed in the cover member 11. By pushing down the snaps 18 from the flow passage member 7 side towards the cover member 11 side, the claws 21 and the engagement areas 23 are engaged with each other when the claws 21 passes through the engagement areas 23. The above engagement prevents the snaps 18 from moving out from the holes 2. The fastening of the members can be performed in a simpler manner with the present embodiment compared with the first embodiment.

The configuration of the snaps is not limited to that illustrated in FIGS. 8B1 and 8B2 and may be configured as illustrated in FIGS. 8C1 and 8C2. In a similar manner to that of the snaps 18 illustrated in FIG. 8B1, snaps 25 illustrated in FIGS. 8C1 and 8C2 include two claws 21 but are different in that there are no slits. By inserting the snaps 25 illustrated in FIG. 8C1 into the holes formed in the cover member 11 and by rotating the snaps in an arrow 24 direction, the claws 21 engage with protruded portions (not shown) of the cover member 11 and the fastening of the recording element substrate 30 and the flow passage member 7 is completed. Furthermore, fastening of the members is not limited to using snaps, and coil springs may be used.

Fourth Embodiment

Figure 9A:
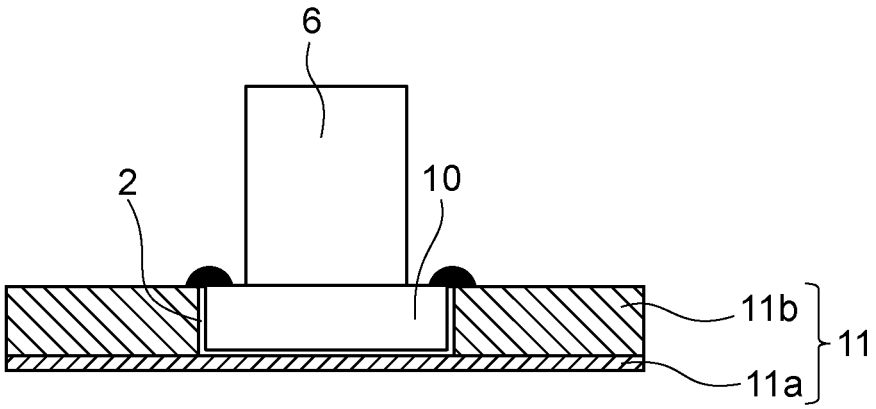
FIGS. 9A and 9B are schematic views illustrating modifications of a fourth embodiment.
Figure 9B:
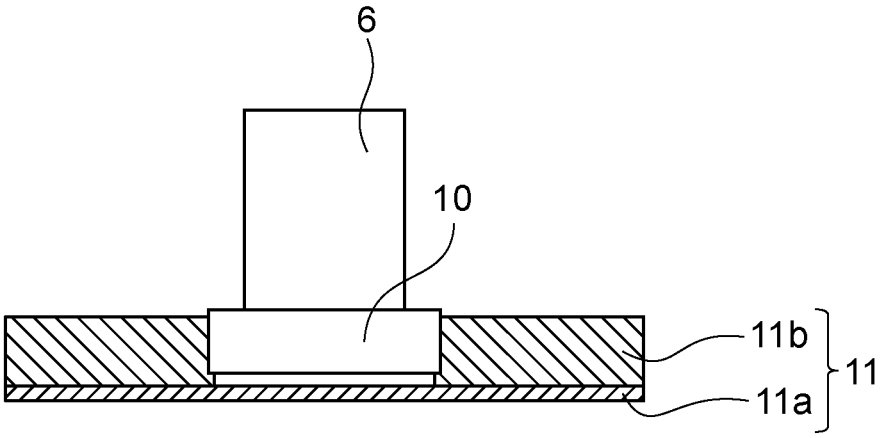

A fourth embodiment of the present disclosure will be described with reference to FIGS. 9A and 9B. Note that components similar to those of the first embodiment will be attached with the same reference numerals and description thereof will be omitted. While the cover member 11 in the first embodiment is constituted by the first plate 11*a*, the second plate 11*b*, and the third plate 11*c*, a characteristic of the present embodiment is that the cover member 11 is constituted by the first plate 11*a* and the second plate 11*b*. FIG. 9A is a schematic view illustrating the cover member 11 and the nut 6 according to the present embodiment, and FIG. 9B is a schematic view illustrating a modification of the cover member 11 and the nut 6 according to the present embodiment.

As described above, the cover member 11 according to the present embodiment is not provided with the third plate 11*c* (FIG. 4A) that includes the engagement areas 23 (FIG. 4A) that engage with the flanges 10 of the nuts. Accordingly, the flanges 10 of the nuts 6 and the cover member 11 are fixed by welding so that the nuts 6 do not move out from the holes 2 of the cover member 11. Electric resistance welding or laser welding is used as the welding method. With the above, the cover member 11 can be a two layered structure including the first plate 11*a* and the second plate 11*b*, which contributes to reducing the cost of the cover member 11. Furthermore, as illustrated in FIG. 9B, the nuts 6 can be fixed to the cover member 11 by press fitting the flanges 10 into the hole of the cover member 11.

Note that in the description of the embodiments, the nuts 6 have been used as the fixing members that engage with the holes 2 of the cover member 11; however, the recording element substrate 30 and the flow passage member 7 may be coupled to each other by directly inserting the bolts in the holes 2 of the cover member 11. Furthermore, in the description given above, the flow passage in which leakage of ink is suppressed by pressing each of the flow passage member 7 and the recording element substrate 30 with the fixing members such as the bolts and the nuts; however, in the present disclosure, the flow passage may be formed by applying an adhesive agent to portions other than the flow passage (around the elastic member). In other words, the flow passage member 7 and the recording element substrate 30 may be fixed with the adhesive agent while the elastic member is in a deformed state. Since the flow passage between the flow passage member 7 and the recording element substrate 30 through which the ink flows is formed by the elastic member, effects similar to those of the embodiments described above can be obtained. However, since the elastic member has a quality of trying to return to its original shape, it is more desirable that the recording element substrate and the flow passage member are coupled to each other with the bolts and the nuts that press the flow passage member and the recording element substrate, which are located on the side towards where the elastic member tries to return, from the outside.

Furthermore, the liquid ejection head according to the present disclosure may be configured so that the liquid (the ink) circulates between an inside of and a portion external to a pressure chamber that includes a pressure generating element for ejecting the liquid. In such a case, a supply port through which the liquid is supplied to the pressure chamber and a collection port through which the liquid supplied inside the pressure chamber is collected are provided in the recording element substrate 30. Accordingly, as the flow passage, at least two flow passages, namely, one for the supply port and one for the collection port are provided in such a recording element substrate. The present disclosure can be applied in a further effective manner in a configuration such as the above in which the flow passages are provided in a highly dense manner.

The present disclosure is capable of providing a liquid ejection head in which leakage of a liquid in a flow passage, between a flow passage member and a recording element substrate, to a portion external to the flow passage can be suppressed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-211665, filed Nov. 9, 2018, which is hereby incorporated by reference herein in its entirety.

What is claimed is:

1. A liquid ejection head comprising:

a recording element substrate including an ejection port that ejects a liquid;

a flow passage member provided with a flow passage that supplies the liquid to the recording element substrate;

a cover member provided with an opening that exposes the ejection port, the cover member being disposed on a surface on a side on which the ejection port of the recording element substrate is formed;

an elastic member having elasticity disposed between the recording element substrate and the flow passage member; and a fixing member that fixes the recording element substrate and the flow passage member, wherein an area between the recording element substrate and the flow passage member through which the liquid flows is sealed by having the elastic member be deformed with the fixing member, the fixing member performs pressing on the recording element substrate by pressing the cover member, and the cover member is formed by layering a thin plate-shaped first plate that is in contact with the surface on the side on which the ejection port of the recording element substrate is formed, and a thin plate-shaped second plate in which a hole portion in which the fixing member is inserted is formed.

2. The liquid ejection head according to claim 1, wherein the fixing member is a bolt and a nut, and the elastic member is deformed with the bolt and the nut by pressing the recording element substrate in a direction extending towards where the flow passage member is disposed when viewed from the recording element substrate and by pressing the flow passage member in a direction extending towards where the recording element substrate is disposed when viewed from the flow passage member.

3. The liquid ejection head according to claim 1, wherein the fixing member is a snap and a washer, and the elastic member is deformed with the snap and the washer by pressing the recording element substrate in a direction extending towards where the flow passage member is disposed when viewed from the recording element substrate and by pressing the flow passage member in a direction extending towards where the recording element substrate is disposed when viewed from the flow passage member.

4. The liquid ejection head according to claim 1, wherein the flow passage member further includes a through hole in communication with the hole portion of the cover member, the fixing member is a bolt and a nut, and the pressing is performed by fastening the bolt inserted in the through hole of the flow passage member and the nut inserted in the hole portion of the cover member.

5. The liquid ejection head according to claim 4, wherein the hole portion of the cover member includes a first area including an opening that is larger than a flange diameter of the nut, and a second area including an opening that is smaller than the flange diameter and that is larger than a flat diameter of the nut.

6. The liquid ejection head according to claim 1, wherein the elastic member is formed of ethylene propylene rubber.

7. The liquid ejection head according to claim 1, wherein a single elastic member is provided for a plurality of the recording element substrates.

8. The liquid ejection head according to claim 1, wherein a single elastic member is provided for a single recording element substrate.

9. The liquid ejection head according to claim 1, wherein the recording element substrate is configured to eject a plurality of types of liquid.

10. The liquid ejection head according to claim 1, wherein the recording element substrate includes a heating element that heats the liquid to eject the liquid.

11. The liquid ejection head according to claim 1, wherein a plurality of the recording element substrates are disposed in a straight line in a longitudinal direction of the liquid ejection head.

12. The liquid ejection head according to claim 1, wherein a plurality of the recording element substrates are disposed in a staggered manner in a longitudinal direction of the liquid ejection head.

13. The liquid ejection head according to claim 1, wherein the liquid ejection head is a page wide liquid ejection head in which a plurality of the recording element substrates are arranged.

14. The liquid ejection head according to claim 1, wherein the recording element substrate includes a supply port that supplies the liquid to a pressure chamber that includes a pressure generating element that applies a pressure to the liquid to eject the liquid, and a collection port that collects, from the pressure chamber, the liquid suppled to the pressure chamber.

15. The liquid ejection head according to claim 1, wherein the fixing member is not exposed when the cover member is viewed from the side on which the ejection port is formed.

* * * * *